US005259213A

United States Patent [19]

Phillippe

[11] Patent Number: 5,259,213

[45] Date of Patent: Nov. 9, 1993

[54] HEAT PUMP EFFICIENCY ENHANCER

[76] Inventor: Gary Phillippe, 7263 Larchmont Dr., North Highlands, Calif. 95660

[21] Appl. No.: 811,166

[22] Filed: Dec. 19, 1991

[51] Int. Cl.[5] ..... F25B 13/00

[52] U.S. Cl. ..... 62/324.1; 62/160; 62/86

[58] Field of Search ..... 62/324.1, 324.6, 86, 62/160

[56] References Cited

U.S. PATENT DOCUMENTS

| | | | |
|---|---|---|---|
| 2,785,540 | 3/1957 | Biehn | 62/324.6 |
| 3,024,619 | 3/1962 | Gerteis et al. | 62/160 |
| 3,274,793 | 9/1966 | Anderson et al. | 62/324.6 |
| 3,365,902 | 1/1968 | Nussbaum | 62/155 |
| 3,537,274 | 11/1970 | Tilney | 62/324.1 |
| 3,918,268 | 11/1975 | Nussbaum | 62/150 |
| 4,171,622 | 10/1979 | Yamaguchi et al. | 62/160 |
| 4,173,865 | 11/1979 | Sawyer | 62/324 |
| 4,266,405 | 5/1981 | Trask | 62/160 |
| 4,449,377 | 5/1984 | Draper | 62/324.1 |
| 4,553,401 | 11/1985 | Fisher | 62/160 |
| 4,563,879 | 1/1986 | Hama et al. | 62/160 |
| 4,745,777 | 5/1988 | Morishita et al. | 62/509 |
| 4,761,964 | 8/1988 | Pacheco | 62/160 |
| 5,038,579 | 8/1991 | Drucker | 62/324.6 |

FOREIGN PATENT DOCUMENTS

| | | |
|---|---|---|
| 0424003 | 4/1991 | European Pat. Off. . |
| 53-38143 | 4/1978 | Japan . |
| 2218193 | 11/1989 | United Kingdom . |

OTHER PUBLICATIONS

Watsco Co. Catalog p. 17 Nov. 1, 1986.

*Primary Examiner*—Albert J. Makay
*Assistant Examiner*—William C. Doerrler
*Attorney, Agent, or Firm*—James M. Ritchey

[57] ABSTRACT

For use with a heat pump to increase cooling and heating efficiency, between an outdoor condenser and an indoor evaporator, a refrigerant receiver or sub-cooler is provided within the high pressure liquid refrigerant portion of the system, including at least one high flow, low pressure release check valve having an internal control element with a refrigerant turbulence producing backside that serves as an incremental expansion device to cool, by incremental expansion, and heat, by turbulence, the high pressure liquid refrigerant.

14 Claims, 4 Drawing Sheets

HEAT PUMP EFFICIENCY ENHANCER

BACKGROUND OF THE INVENTION

1. Field of the Invention

This invention relates to a modified and improved refrigerant recycling heat pump system or a retrofit alteration to an existing heat pump system that enhances the system's efficiency by pre-cooling or pre-heating the refrigerant. Between first and second heat exchangers is provided at least one high flow, low pressure release check valve that serves as an incremental expansion device that heats by producing turbulence in the high pressure liquid refrigerant before the refrigerant enters the traditional expansion device immediately prior to an outdoor heat exchanger. Further, between first and second heat exchangers is provided at least one high flow, low pressure release check valve that serves as an incremental expansion device to cool partially the high pressure liquid refrigerant before the refrigerant enters the traditional expansion device immediately prior to an indoor heat exchanger. Additionally, a liquid refrigerant receiver for sub-cooling is provided.

2. Description of the Background Art

Devices relying upon standard heat pump technologies have been available for many years. Within the limits of each associated design specification, these devices enable a user to cool or heat a selected environment. For these heating and cooling duties, in general, refrigerant gases or liquids are compressed, expanded, heated, or cooled within an essentially closed system to produce a desired temperature result in the selected environment. To accomplish the heating and cooling, heat is transferred from one location to another.

Within the plumbing that couples the various refrigeration or heat pump components are three devices of particular import with the subject device. First, check valves are traditionally employed to prevent the backflow of refrigerant. For a heat pump, often check valves are configured to direct refrigerant down a desired path during the cooling cycle and a significantly different path during the heating cycle. Several types of check valves exist. A common check valve has a spring controlled gate that increase its resistance to refrigerant flow as the spring is displaced from its rest position. Gravity check valves function by having a ball or similar object forced by gravity into a receiving seat to block reverse flow of the refrigerant.

Second, expansion devices serve to divide the high pressure side of the system from the low pressure side of the system by feeding the liquid refrigerant to the evaporator at a rate that, hopefully, optimizes the efficiency of refrigerant vaporization. Therefore, the refrigerant pressure drops significantly across the expansion device and the flow of refrigerant is regulated or decreased to a desired level. Automatic (constant pressure), float and surge chamber (constant liquid level), and, preferably, thermostatic designs represent the three major types of expansion valves.

Third, traditional sub-coolers partially cool the refrigerant prior to the expansion device and subsequent evaporator. Such refrigerant sub-cooling has been shown to increase the efficiency of the heat transfer within the evaporator. Various types of sub-coolers exist, but the most common form cools the refrigerant by drawing in cooler liquid to surround the warmer refrigerant.

Concerning existing references, specifically, U.S. Pat. No. 3,024,619 relates a heat pump system having an additional row of finned tubes on the condenser. Due to a first associated check valve, the additional finned tubes act as a sub-cooler during a cooling cycle. When the system is run in reverse direction for heating, a second check valve passes coolant through the auxiliary coil thereby increasing heating capacity during the heating cycle without adversely affecting cooling operation. No direct monitoring coolant temperatures or pressures are associated with the regulation of this process.

A reverse cycle refrigeration system is disclosed in U.S. Pat. No. 3,365,902. The apparatus acts as a heat pump or as a system having a normal refrigeration phase and a hot gas defrost phase. A set of heat source coils forming a distinct refrigerant circuit is separate from the condenser coils but contained in a common fin bundle with the condenser coils.

U.S. Pat. No. 3,537,274 provides a dual evaporator refrigeration system. The system permits alternate connection of the evaporators for cooling while using the liquid refrigerant as the source of heat for defrosting the disconnected evaporator. There are two separate evaporators and a four-way valve for alternately connecting one or the other evaporator to the outlet side of the expansion device. The other evaporator is connected in the liquid refrigerant flow line so that liquid refrigerant passes through it. This liquid refrigerant serves as the source of heat for defrosting the evaporator not being used. As the fourway valve switches, the actions of the evaporators switch.

Disclosed in U.S. Pat. No. 3,918,268 is a heat pump with a frost-free outdoor coil. A heating means is associated with the normal outside coil to prevent the surface temperature of the outside coil from falling below 32° C. Means are provided to prevent liquid floodback into the compressor when a changeover occurs from heating to cooling.

Described in U.S. Pat. No. 4,171,622 is a heat pump including an auxiliary outdoor heat exchanger acting as a defroster and sub-cooler. Located underneath the main outdoor heat exchanger and connected between the indoor and main outdoor heat exchangers is the auxiliary exchanger. During cooling the auxiliary exchanger acts as a sub-cooler and during heating it functions as a defroster for melting a block of ice that may have accumulated under or within the main outdoor heat exchanger. FIG. 1 indicates a check valve after the outdoor heat exchanger and prior to the sub-cooler, however, this check valve is merely to prevent, during the heating operation, the passage of refrigerant, thereby directing the refrigerant into the capillary tube (see column 4, lines 65–68).

U.S. Pat. No. 4,173,865 relates an auxiliary coil arrangement for a heat pump. The auxiliary coil is connected in parallel refrigerant flow arrangement with the expansion device of the heat pump. Standard check valves are provided to permit the auxiliary coil to function as a sub-cooler when the associated heat exchanger functions as a condenser.

Presented in U.S. Pat. No. 4,266,405 is a heat pump refrigerant circuit to reduce the time length of defrost cycles in contemporary air-to-air heat pumps. This reduction is accomplished by having two parallel refrigerant circuits connect the reversing valve to an outdoor coil. To regulate the direction of refrigerant flow, standard check valves are included.

A thermosyphon coil arrangement for a the outside unit of a heat pump is described in U.S. Pat. No. 4,449,377. When the heat pump is operating in the heating mode, the refrigerant flow is controlled by thermosyphoning action. Further, the coil placement and refrigerant flow are arranged for an outdoor unit so that the coil operates in an optimal thermosyphon fashion in the heating mode.

U.S. Pat. No. 4,553,401 discloses a reversible cycle heating and cooling system. Introduced is an auxiliary outdoor heat exchanger that is coupled with a water source for enhancing the capacity and efficiency of the system to transfer heat to the refrigerant during the heating mode at low outdoor ambient temperatures. A traditional check valve to water cooled refrigerant concentrator is indicated in both the cooling and heating cycles of the device.

A capillary tube-type expansion device for a heat pump is explained in U.S. Pat. No. 4,563,879. To regulate the device, a control unit detects the temperature of the outside air and the discharge water temperature of a water-cooled heat exchanger and applies a suitable control signal to an electrical expansion valve.

An apparatus for enhancing the performance of a heat pump is given in U.S. Pat. No. 4,761,964. First and second auxiliary coils are heated with associated radiant quartz heating elements. Outdoor temperature is employed, via a pair of thermostats, to regulate the operation of the quartz heaters.

Provided in Japanese Patent No. 38, 143 is a heat pump type system having first and second units. The amount of cooling medium is regulated to provide maximum heating and cooling capacity.

Co-pending U.S. patent application Ser. No.: 07/728,737, filed on Jul. 12, 1991, discloses the high flow, low pressure release check valves and associated sub-cooler-receiver of the subject invention in use with a refrigeration system, primarily employed as an air conditioning unit for cooling an enclosure.

SUMMARY OF THE INVENTION

An object of the present invention is to produce means for enhancing both the heating and cooling efficiency of a heat pump system.

Another object of the present invention is to relate a means for slightly decreasing the pressure of high pressure liquid refrigerant within a heat pump system to a pressure level that corresponds to a partially lowered temperature of the refrigerant, thereby enhancing the efficiency of the evaporation process.

A further object of the present invention is to disclose the use of a high flow, low pressure release check valve that serves as an incremental expansion valve both for partially lowering the pressure of high pressure liquid refrigerant within a heat pump system and to generate turbulence in the refrigerant's flow that is dependent upon the refrigerant's flow rate so that a slower refrigerant flow rate generates more turbulence than a faster flow rate.

An additional object of the present invention is to make an enhanced efficiency heat pump system by employing at least one high flow, low pressure release check valve that serves as an incremental expansion valve in combination with a high pressure liquid refrigerant receiver that aids in sub-cooling the refrigerant before evaporation.

Yet an additional object of the present invention is to provide a high flow, low pressure release check valve that has an internal refrigerant flow control element with a refrigerant turbulence producing backside surface that produces a low pressure volume proximate the backside surface, thereby creating cooling of the refrigerant via a pressure difference and generating more turbulence and heat in the flowing refrigerant at lower flow rates than at higher flow rates.

Still another object of the present invention is to create a device that aids in preventing "freeze-up" of the evaporator in a heat pump during use of the heat pump for heating on cold days.

Disclosed is a particularly efficient method of operating a heat pump during either heating or cooling cycles or modes, at least one refrigerant high flow, low pressure release check valve is included in a bypass line between two heat exchangers. Between an indoor evaporator (first heat exchanger) and an outdoor condenser (second heat exchanger), a refrigerant bypass line is installed that usually includes a high pressure liquid refrigerant receiver or sub-cooler. Immediately before the receiver, but still within the high pressure liquid refrigerant portion of the system, is at least one, usually four, high flow, low pressure release check valves. Each low pressure release check valve serves as an incremental expansion device either to heat partially the high pressure liquid refrigerant (by introducing turbulence into the flowing refrigerant at low refrigerant velocity) or to cool partially the high pressure liquid refrigerant (due to a pressure drop in the refrigerant as it passes the valve at a high velocity where refrigerant flow is subject to less turbulence) before the refrigerant enters a traditional expansion device immediately prior to the appropriate heat exchanger.

Other objects, advantages, and novel features of the present invention will become apparent from the detailed description that follows, when considered in conjunction with the associated drawings.

DESCRIPTION OF THE PREFERRED EMBODIMENT

Figure 1:
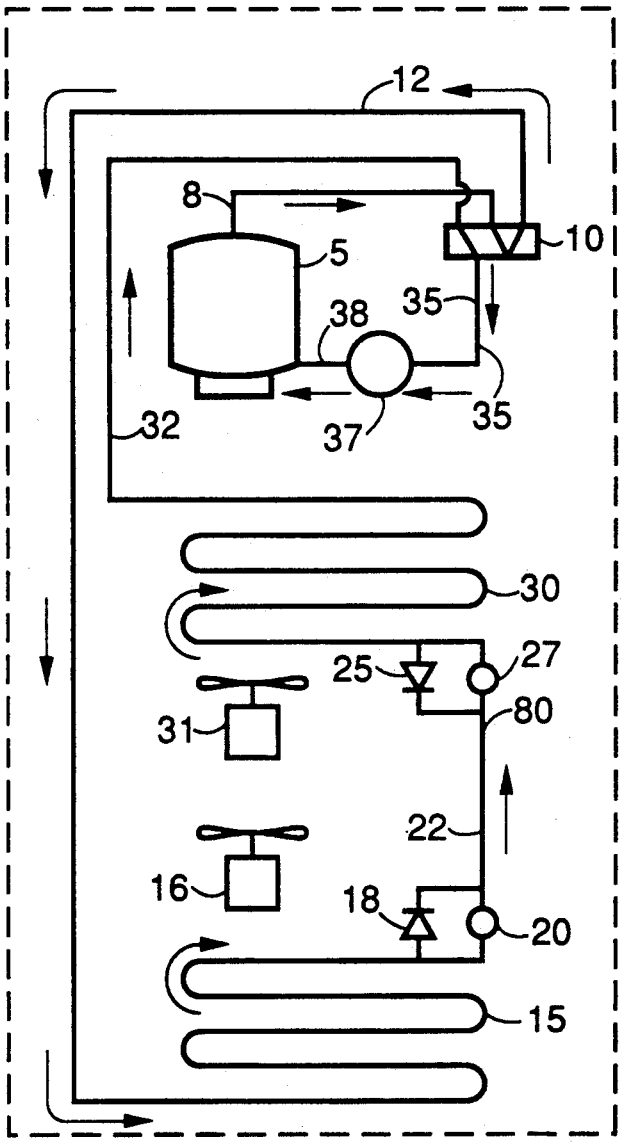
FIG. 1 is a schematic diagram showing the flow of refrigerant during a typical heating cycle for a generalized heat pump system.

Referring now to FIG. 1 for a generalized heat pump. To quickly appreciate the benefits of the subject device, a brief description of the functioning of a heat pump is presented. An expandable-compressible refrigerant is contained and cycled within an essentially enclosed system comprised of various refrigerant manipulating components. The selection of the refrigerant is within the skill of one familiar with the relevant art, but standard FREON refrigerants (like FREON-22 TM (R-22) and equivalent materials for a typical home setting) and the like are acceptable. When a liquid refrigerant expands to produce a gas it increases its heat content at the expense of a first surrounding environment which decreases in temperature. The heat rich refrigerant is transported to a second surrounding environment and the heat content of the expanded refrigerant released to the second surroundings via condensation, thereby increasing the temperature of the second surrounding environment. Heating or cooling conditions are generated in the first and second environments by reversing the process within the enclosed system. Customarily, when a heat pump is utilized to regulate the temperature within a building, the first environment is within the structure and the second environment is outside the structure (a building is described as an example only and other environments such as those used with standard refrigeration units are considered to be within the realm of this disclosure). To heat the interior of a building, expanded, heat rich refrigerant is produced within the enclosed system at the expense of second or outside environment's energy. For cooling the system is reversed.

As, indicated, FIG. 1 depicts a typical heat pump system, but it must be stressed that the subject invention is suitable for initial installation in a heat pump or for modifying any equivalent heat pumps systems. Regardless of whether of not the heat pump is functioning as a cooling or heating unit, a compressor 5 dispenses high pressure gaseous refrigerant through flow line 8 into a four-way switchable valve 10. The four-way valve 10 serves as a means for reversing the direction of refrigerant flow during a heating or cooling cycle.

Specifically, for a heating cycle in a standard heat pump, the high pressure expanded or gaseous refrigerant exits the four-way valve 10, passes through a flow line 12 and into an indoor condenser 15 (when the unit is used in a heating cycle, the term condenser is often used, but generally the unit is an indoor or first environment heat exchanger). The high pressure gaseous refrigerant condenses into a liquid, thereby releasing much of its heat content to warm the surrounding air. A blower or fan 16 aids in distributing the released warmed air within the building.

The liquid refrigerant travels from the indoor condenser 15, usually regulated to unidirectional flow by a check valve 18 past TX expansion valve 20, into a flow line 22 and generally past a check valve 25 and through an TX expansion valve 27 (employed to allow a limited amount of refrigerant expand within the following heat exchanger) into an outdoor evaporator 30 (when the unit is used in a heating cycle, the term evaporator is often used, but generally the unit is an outdoor or second environment heat exchanger). Within the outdoor evaporator 30 heat is taken on by the refrigerant (aided by a blower or fan 31 to circulate the air), which gasifies and returns via flow line 32 to the four-way valve 10. Exiting the four-way valve 10, the expanded refrigerant moves by suction through flow line 35, usually passing through a standard accumulator 37, and into the compressor 5, by way of a final flow line 38. The returning refrigerant, via line 38, is at a lower pressure than the compressor exiting refrigerant, at line 8. Various modifications of this process can occur are within the purview of this disclosure.

For a cooling cycle in a standard heat pump, the high pressure gaseous or expanded refrigerant is produced by the compressor 5 and fed into the flow line 8, as with the heating process above. However, for cooling the inside of a building (first environment) the four-way valve 10 is positioned to direct the flow of the high pressure refrigerant into line 32, thereby reversing the refrigerant flow direction (the opposite flow shown in FIG. 1) through the indoor 15 and outdoor 30 heat exchangers. The high pressure liquid refrigerant enters into the indoor 15 heat exchanger via expansion valve 20.

Figure 2:
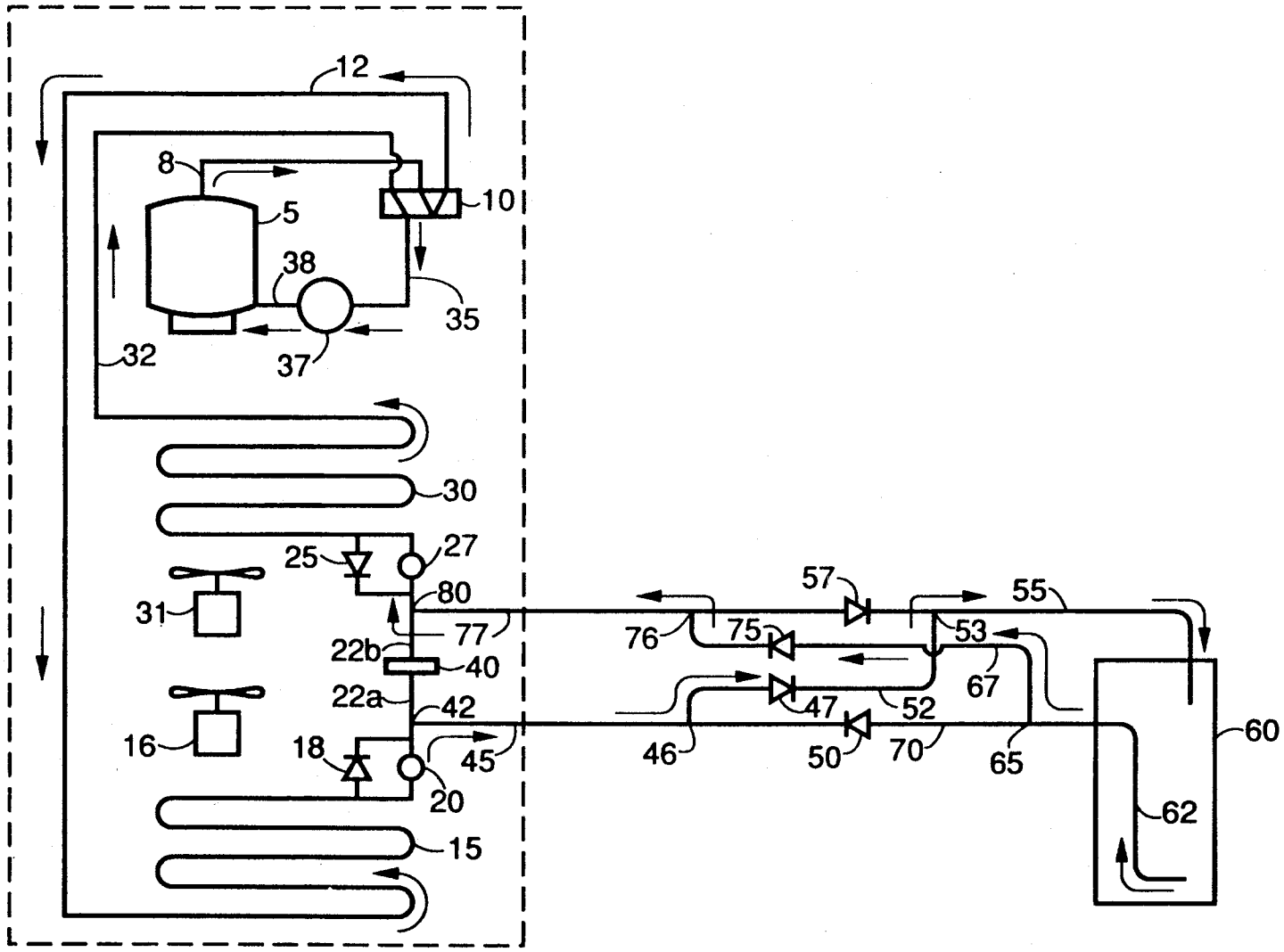
FIG. 2 is a schematic diagram showing the subject apparatus attached to the generalized heat pump system of FIG. 1, including the flow of refrigerant during a heating cycle.
Figure 3:
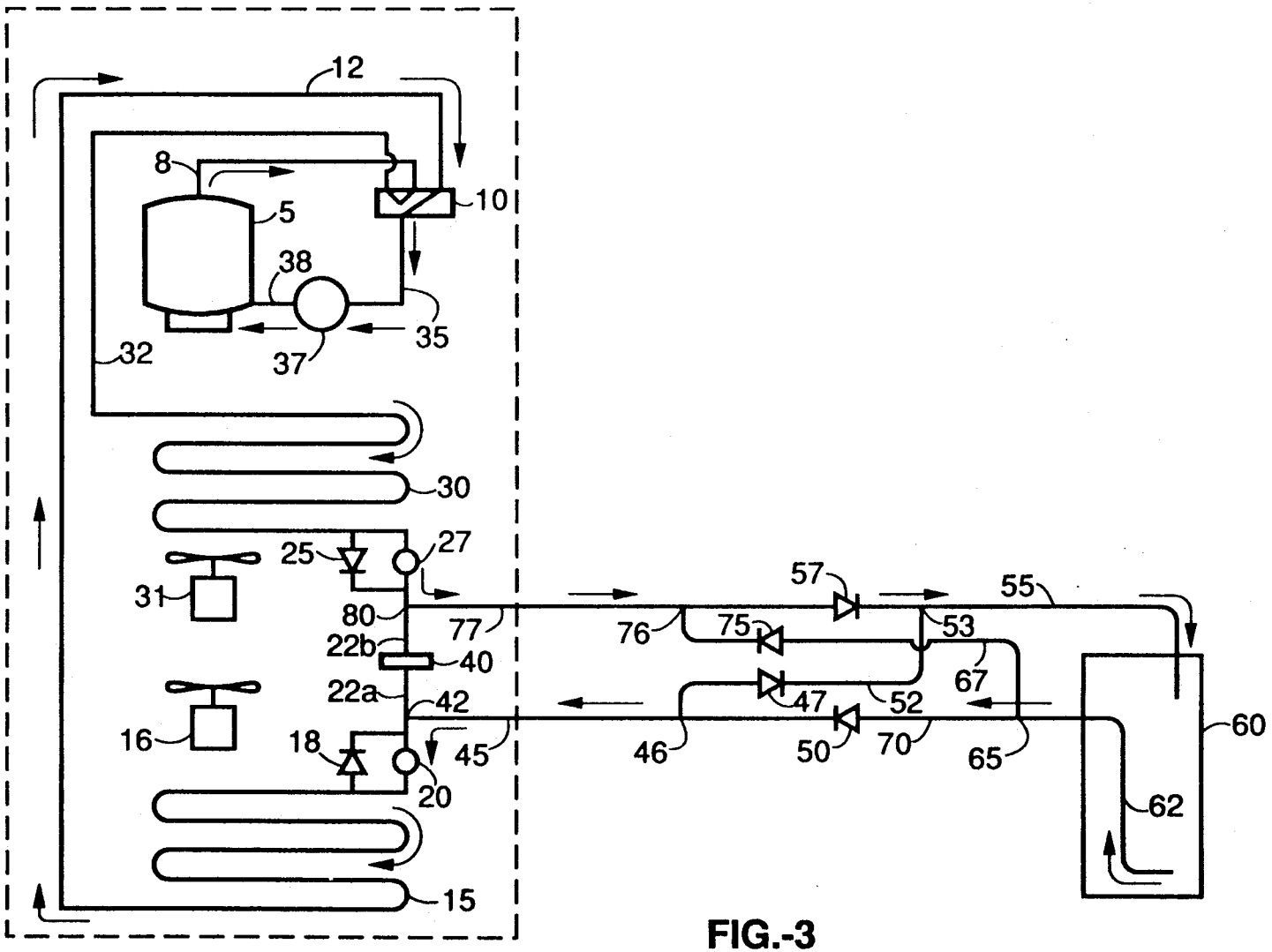
FIG. 3 is a schematic diagram showing the subject apparatus attached to the generalized heat pump system of FIG. 1, including the flow of refrigerant during a cooling cycle.

FIGS. 2 and 3 indicate the subject invention coupled into an existing heat pump and operating in an enhanced heating mode (see FIG. 2) and an enhanced cooling mode (see FIG. 3). Illustrated is a preferred manner in which the subject device is coupled into an existing heat pump with one set of connections between the indoor and outdoor heat exchangers. Even though the preferred method of use for the subject device is in the modification of a pre-existing heat pump, it must be stressed that the subject device applies equally well to the production of new heat pumps or refrigeration systems that incorporate the subject invention in their original design.

The efficiency of the heating or cooling modes of the heat pump are enhanced by employing at least one high flow, low pressure release check valve within a bypass line that diverts high pressure liquid refrigerant into an alternate course between the two heat exchangers. To increase the efficiency of the cooling mode of operation the high pressure liquid refrigerant passes through at least one (preferably two) high flow, low pressure release check valve in the bypass line. To increase the efficiency of the heating mode operation the high pressure liquid refrigerant passes through at least one (preferably two) high flow, low pressure release check valve in the bypass line.

The rationale for the cooling effect of the high flow, low pressure release check valve is that as the high pressure liquid refrigerant passes the high flow, low pressure release check valve a slight drop in pressure occurs that results in partial cooling of the refrigerant. As indicated below in detail, the selection of the high flow, low pressure release check valve includes a mechanism within the valve that produces a turbulence in the flowing refrigerant as it passes through the valve. The amount of turbulence varies as the speed of the liquid refrigerant varies. At higher liquid refrigerant speeds the turbulence decreases, but at lower liquid refrigerant speeds the turbulence increases. Normally, the partial expansion of the refrigerant at the higher flow velocity results in mostly cooling, however, at the slower flow velocity turbulence causes a significant heating of the refrigerant.

As a general illustration of the heat pump efficiency enhancement properties of the subject device the following two examples are presented. First, for enhanced cooling efficiency, the outside temperature is about 100° F. and the home's inside temperature is about 85° F. The inside temperature is to be lowered to about 75° F. At 85° F., the high pressure liquid refrigerant has a greater flow velocity than at 75° F., therefore, less heating turbulence is generated as it passes through a high flow, low pressure release check valve. The refrigerant enters a bypass line that has at least one high flow, low pressure release check valve that serves to cool partially the refrigerant. Usually, a sub-cooling liquid receiver is also placed in this bypass line to further cool the refrigerant. As the home's temperature approaches the desired 75° F. a slower refrigerant flow velocity occurs that gradually results in heating of the high pressure liquid refrigerant. The net result of having the high flow, low pressure release check valve in the bypass line is increased efficiency in cooling the home.

As a second, for enhanced heating efficiency, the outside temperature is about 45° F. and the home is to be heated from about 65° F. to about 80° F. At 65° F. the refrigerant entering the high flow, low pressure release check valve is flowing at a slower velocity than at the higher 80° F. final temperature. Therefore, as the home heating starts the refrigerant is slightly heated by turbulence in the high flow, low pressure release check valve, but as the homes heats the refrigerant flow velocity increases, thereby decreasing the turbulence within the high flow, low pressure release check valve producing a cooling of the refrigerant. When slightly heated refrigerant is sent to the evaporator it is not as likely to freeze.

FIG. 2 (illustrating a refrigerant flow direction for a heating mode operation) shows that a clamp or block 42 has been introduced into the flow line 22 that connects a first or indoor 15 heat exchanger and a second or outdoor 30 heat exchanger. The block 42 completely prevents the refrigerant from directly passing the point at which the block 42 is attached. Any suitable method of blocking the line is contemplated, including a clamp, valve, weld, and the like. The original flow line 22 is split into new flow lines 22*a* and 22*b*.

To the indoor heat exchanger 15 side of the block 40 is a T-joint or elbow 42 that permits the liquid refrigerant (condensed refrigerant after the indoor condenser or heat exchanger 15) to flow from line 22*a* into the bypass line or specifically first into line 45. Flow line 46 branches from line 45 and include a check valve 47 that permits refrigerant flow into line 52 but not the reverse. Preferably, check valve 47 is a high flow, low pressure release check valve that serves to heat partially the refrigerant as it travels through the valve at low velocity. Refrigerant is prevented from exiting line 45 into line 70 by check valve 50 (which in the cooling mode is optionally a high flow, low pressure release check valve). Liquid refrigerant passes from line 52 through T-joint 53 into line 55. Check valve 57 (which in the cooling mode is a high flow, low pressure release check valve) blocks the loss of refrigerant into line 77. Refrigerant exits flow line 55 into a high pressure liquid receiver 60. The receiver 60 partially cools the liquid refrigerant by allowing the liquid refrigerant to expand slightly. Following the slight refrigerant expansion, the liquid refrigerant exits the receiver 60 into flow line 62. Due to the slight refrigerant expansion, the flow line pressure of the liquid refrigerant before the receiver 60 is higher than after the receiver 60. The difference in pressure is usually less than about 1 psi (pounds per square inch) and usually about 0.5 psi, but other equivalent pressure values are considered acceptable.

During heating, the liquid refrigerant exits the receiver 60 via line 62 and encounters a flow line T-joint 65 connecting line 62 with flow lines 67 and 70. Since the liquid refrigerant pressure in line 46 is slightly greater than in line 70, the refrigerant flow is restricted from passing check valve 50. Therefore, the refrigerant flow is directed down line 67, through check valve 75, through T-joint 76, and into line 77. Depending upon the exact requirements of the system for needed extra refrigerant heating (minimal refrigerant heating from only having check valve 47 being a high flow, low pressure release check valve that receives high pressure liquid refrigerant in the heating mode but larger systems may require two or more high flow, low pressure release check valves), usually, check valve 75 is a high flow, low pressure release check valve that serves to heat partially the refrigerant as it travels through the valve at low velocity. Under these operating conditions, since the pressure in line 55 is greater than the pressure in line 77, the refrigerant flow does not pass check valve 57 into line 55. The liquid refrigerant in line 77 reenters the standard heat pump plumbing at flow line 22*b* via T-joint or elbow connection 80.

Refrigerant passes, via expansion valve 27, into the second or outdoor heat exchanger 30, continuing through line 32, entering the four-way valve 10, and exiting through flow line 35. The refrigerant then flows to the compressor 5 via accumulator 37 and line 38. Once again, it should be remembered that various heat pump configurations exist and the subject invention's exact connection points into the flow lines might need to be altered, without effecting the general scheme of the flow of refrigerant through the bypass, to account for these differences.

The efficiency of the cooling mode operation of the heat pump is enhanced by including an incremental expansion device as check valve 50 and optionally (larger heat pumps requiring an additional incremental expansion device for added efficiency) as check valve 57. Comprising the cooling efficiency enhancing means is a high flow, low pressure release check valve 57, for incrementally lowering the pressure of the high pressure liquid refrigerant prior to the expansion valve 20. As noted above, at higher refrigerant flow rates the transition of the refrigerant across the high flow, low pressure release check valve is smoother than a slower flow rates, thereby cooling, by slight pressure difference, the refrigerant at high flow rates and heating, by turbulence, the refrigerant at slow flow rates. Additionally, the sub-cooler receiver 60 is provided for incrementally lowering the pressure of the high pressure liquid refrigerant. Further, for large refrigeration systems, check valve 50 is a high flow, low pressure release check valve.

During enhanced cooling, flow line 77 connects with means for sub-cooling the high pressure liquid refrigerant. If properly selected, check valve 57 can operate as an incremental refrigerant cooling device. Coupled with flow line 77 is a high flow, low release pressure check valve 57 (for the details of this valve, see FIG. 4 and below following the general overall system description). Since one purpose of the high flow, low release pressure check valve 57 (and optionally 5C for cooling) is to permit a slight decrease in the pressure of the high pressure liquid refrigerant with minimal turbulence, check valve 57 (and optional equivalent component 50, see below) is a type of incremental expansion valve that permits only a slight decrease in the high pressure of the liquid refrigerant before the TX valve 20 allows normal high to low pressure conversion.

In enhanced cooling, following the high flow, low pressure release check valve 57 is flow line 55 that delivers high pressure liquid refrigerant into the receiver 60. The receiver 60 acts to partially sub-cool the refrigerant by allowing the liquid refrigerant to expand slightly. Following the receiver is a flow line 62 that carries the refrigerant through an optional high flow, low release pressure check valve 50. It has been found that valve 57 (serving as an incremental expansion valve) is generally sufficient in sub-cooling refrigerant for refrigeration systems having a capacity of less than about three tons. However, a refrigeration system over about three tons capacity generally requires additional sub-cooling to significantly enhance its efficiency and in such cases check valve 50 is a high flow, low release pressure valve serving as a second incremental expansion valve.

In the cooling mode, a gradual stepped regulation of the temperature of the refrigerant, before the TX expansion valve 20, that results in sub-cooling of the refrigerant can significantly enhance the efficiency of the evaporation process. As noted above, the subject invention accomplishes the sub-cooling process by including at least one high flow, low release pressure check valve 50 or 57 before the TX valve 20. It is important that the type of check valve 50 or 57 employed for sub-cooling has a configurational design that permits a high flow rate of refrigerant. With a high flow rate of the refrigerant the efficiency of the compressor 5 is maintained. Whenever a pressure drop occurs across a standard, usually a spring type, check valve the refrigerant's temperature drops. However, with meaningful refrigerant cooling comes a significantly decreased refrigerant flow rate with such a high pressure (spring or equivalent forms) release check valve. This decreased flow rate is counter productive to any added sub-cooling since, as noted, the compressor 5 needs to exert more energy to circulate the restricted refrigerant.

Incorporation of a check valve comprising a high flow rate is achieved by including a one-way mechanism that requires a low pressure of refrigerant to release the mechanism, thereby not significantly hampering the efficiency of the compressor 5. Such a high flow, low release pressure check valve regulated sub-cooling of the subject invention typically results in dropping the temperature of the high pressure liquid refrigerant (typically a common FREON ®, but other refrigerants are possible) from about 102° F. to about 92° F. (the equivalent of approximately 30 pounds pressure). These numbers are by way of example only and not intended to limit the operational range of the subject invention nor the type of refrigerant employed..

Although any check valve (50 or 57 for cooling and 47 or 75 for heating) that has high flow and low pressure release characteristics that generates a higher liquid refrigerant turbulence at slower refrigerant flow velocities is contemplated as acceptable by this disclosure, in particular, a magnetic check valve is preferred. Once the initial release of the magnetic force is achieved, additional flow requires less energy. Such a valve is a MagniChek TM check valve produced by the Watsco, Inc. (Watsco, Inc., 615 W. 18th Street, Hialeah, FL 33010). Although a Watsco check valve is described in general below, other similar devices are suitable.

Figure 4:
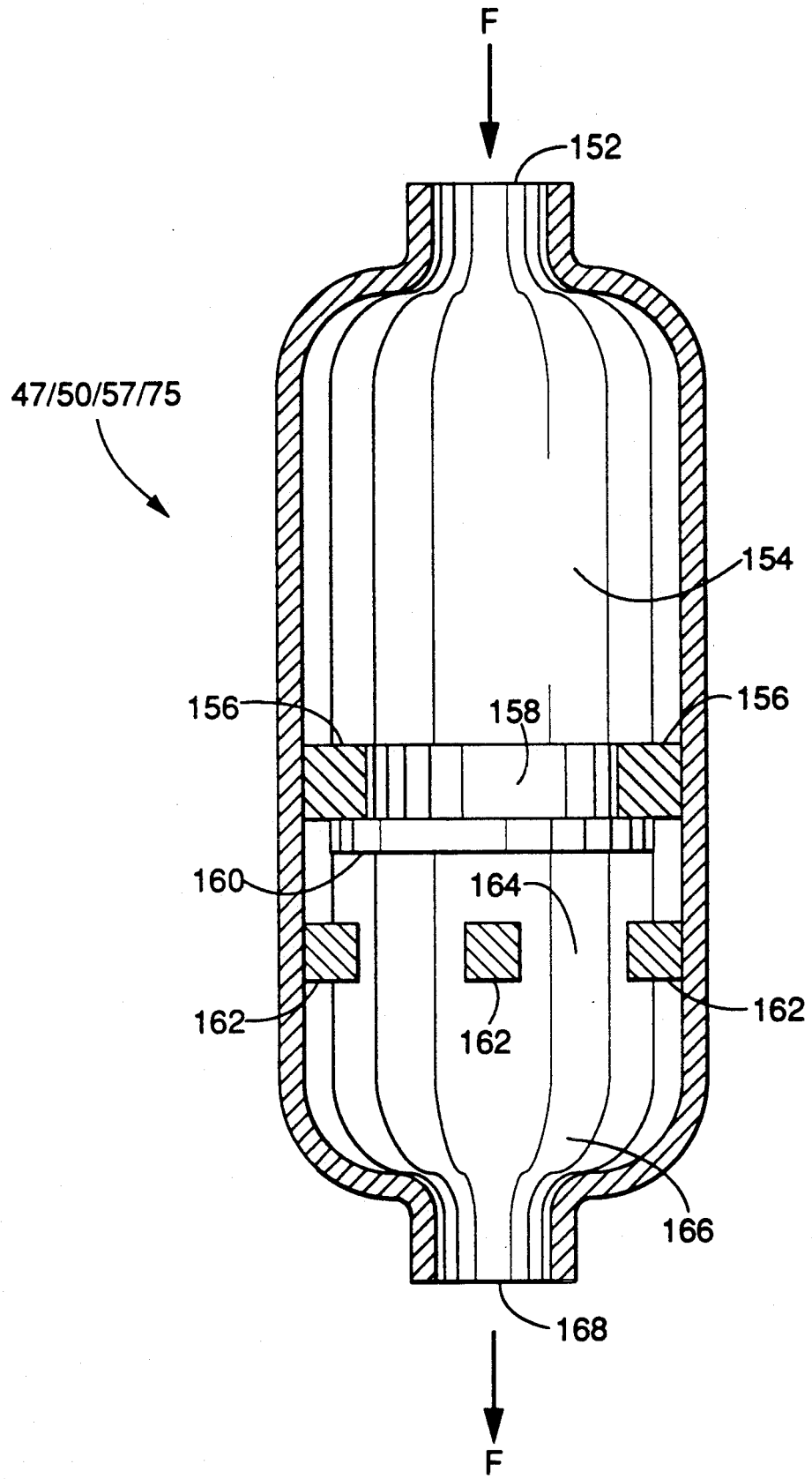
FIG. 4 is a cross sectional view of a typical refrigerant high flow, low pressure release check valve employed to partially reduce the pressure of the high pressure liquid refrigerant.

A generalized magnetic check valve is illustrated in FIG. 4. Various equivalent alternative forms are considered appropriate for the subject invention, however, comprising a typical magnetic check valve is a refrigerant entrance 152 (see refrigerant flow direction F). The refrigerant enters a chamber 154 and encounters a permanent magnet 156, usually of a donut type configuration, or equivalent form, fastened to the inside wall of the valve. Passing through the magnet 156 is at least one flow port 158. Magnetically secured to the magnet 156 is a control element. Depending on the exact shape of the magnet 156, the shape of the control element will change. Each control element has a frontside surface, that faces the oncoming refrigerant and a backside surface, that is downstream from the refrigerant flow or faces away from the oncoming refrigerant. As long as the control element's frontside surface seals against a receiving surface, in this case the surface of the magnet 156, the frontside surface may be flat, cone shaped, or the equivalent.

Preferably, the control element is a refrigerant turbulence producing valve plate 160, usually having a flat backside but the backside may be concave or convex. Typically, the high pressure liquid refrigerant turbulence is minimal when the refrigerant flow rate approaches its maximum velocity and maximal when the flow rate approaches its minimum velocity within the heat pump bypass line. Often, this turbulence will increase the temperature of high pressure liquid refrigerant entering the bypass line from an entrance value of about 85° F. to about 91° F. (these values are for exemplary purposes only and are not intended to limit the range of heating due to turbulence). The frontside of the plate 160 mates with the magnet's 156 receiving surface. When the refrigerant pressure in the range of at least about 0.5 to about 2.0 psi, preferably about 1 psi, presses against the plate's 160 frontside surface, from the refrigerant entrance side, the plate 160 is displaced away from the magnet 156 and the refrigerant passes by the plate 160. Since the backside surface of the control element (plate 160) is shaped to produces turbulence in the refrigerant proximate the backside surface, as the refrigerant flows past the plate 160 a low pressure volume is generated proximate the backside surface (low pressure proximate the backside surface relative to the frontside surface pressure), thereby producing a lowering in the temperature of the refrigerant via a pressure difference in front of and behind the plate 160. As indicated, the backside surface is usually flat, however, a backside surface that is concave or convex or any other configuration that generates the low pressure volume is contemplated to be within the realm of this disclosure. According to standard hydrodynamics, as the fluid increases its flow rate less turbulence in the refrigerant is evident and as the refrigerant velocity slows, at lower temperatures, more turbulence is generated.

The plate 160 is retained by a valve plate stop 162, which may be present in several equivalent configurations. The released refrigerant travels past the plate stop 162 via one or more flow channels 164 and enters an exit chamber 166. Finally, the incrementally cooled or heated refrigerant leaves the valve via a refrigerant exit 168 and proceeds to the receiver 60 and then to check valve 50, which is optionally a high flow and low pressure release valve as described above.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. In association with a refrigerant recirculating heat pump system, wherein said heat pump system has a compressor, a first heat exchanger, a second heat exchanger, and a first refrigerant flow line connecting said first and said second heat exchangers, wherein said system heats an environment associated with said first heat exchanger by transferring said refrigerant in a high pressure liquid form in a first direction through said first refrigerant flow line from said first heat exchanger to said second heat exchanger and cools said first heat exchanger associated environment by transferring said refrigerant in said high pressure liquid form in a second direction from said second heat exchanger to said first heat exchanger, enhancement means for increasing the efficiency of said heat pump, comprising:

a) a refrigerant block in said first refrigerant flow line between said first heat exchanger and said second heat exchanger, wherein said block prevents the direct flow of high pressure liquid refrigerant between said first heat exchanger to said second heat exchanger;

b) a bypass refrigerant line extending between said first and said second heat exchangers for carrying said high pressure liquid refrigerant around said refrigerant block; and c) means associated with said bypass refrigerant line for enhancing said heat pump system's efficiency, wherein said enhancement means comprises at least one high refrigerant flow, low pressure release check valve inserted into said bypass line for incrementally lowering said liquid refrigerant's high pressure before entering said first heat exchanger from said second heat exchanger in said second direction of said refrigerant flow, thereby enhancing said heat pump system's cooling efficiency.

2. Means for cooling enhancement according to claim 1, further comprising a liquid refrigerant receiver inserted within said bypass flow line for incrementally lowering the pressure of said high pressure liquid refrigerant.

3. Means for cooling enhancement according to claim 1, wherein said high refrigerant flow, low pressure release check valve comprises a one-way refrigerant flow mechanism that requires between about 0.5 psi and 2.0 psi to pass refrigerant.

4. Means for cooling enhancement according to claim 1, wherein said high refrigerant flow, low pressure release check valve comprises a one-way refrigerant flow mechanism having a refrigerant flow control element with a backside surface that produces less refrigerant turbulence as the flow of said refrigerant increases and more refrigerant turbulence as the flow of said refrigerant decreases.

5. Means for cooling enhancement according to claim 1, wherein said high refrigerant flow, low pressure release check valve comprises a one-way refrigerant flow mechanism having a permanent magnet and magnet attracted valve plate that requires between about 0.5 psi and 2.0 psi to pass refrigerant.

6. Means for cooling enhancement according to claim 1, wherein said high refrigerant flow, low pressure release check valve comprises a one-way refrigerant flow mechanism having a permanent magnet and magnet attracted valve plate, wherein said valve plate has a backside surface that produces less refrigerant turbulence as the flow of said refrigerant increases and more refrigerant turbulence as the flow of said refrigerant decreases.

7. In association with a refrigerant recirculating heat pump system, wherein said heat pump system has a compressor, a first heat exchanger, a second heat exchanger, and a first refrigerant flow line connecting said first and said second heat exchangers, wherein said system heats an environment associated with said first heat exchanger by transferring said refrigerant in a high pressure liquid form in a first direction through said first refrigerant flow line from said first heat exchanger to said second heat exchanger and cools said first heat exchanger associated environment by transferring said refrigerant in said high pressure liquid form in a second direction from said second heat exchanger to said first heat exchanger, enhancement means for increasing the efficiency of said heat pump, comprising:

a) a refrigerant block in said first refrigerant flow line between said first heat exchanger and said second heat exchanger, wherein said block prevents the direct flow of high pressure liquid refrigerant between said first heat exchanger to said second heat exchanger;

b) a bypass refrigerant line extending between said first and said second heat exchangers for carrying said high pressure liquid refrigerant around said refrigerant block; and c) means associated with said bypass refrigerant line for enhancing said heat pump system's efficiency, wherein said enhancement means comprises at least one high refrigerant flow, low pressure release check valve inserted into said bypass line for incrementally heating said liquid refrigerant by producing turbulence in said liquid refrigerant first direction refrigerant flow before entering said second heat exchanger from said first heat exchanger, thereby enhancing said heat pump system's heating efficiency.

8. Means for heating enhancement according to claim 7, wherein said high refrigerant flow, low pressure release check valve comprises a one-way refrigerant flow mechanism that requires between about 0.5 psi and 2.0 psi to pass refrigerant.

9. Means for heating enhancement according to claim 7, wherein said high refrigerant flow, low pressure release check valve comprises a one-way refrigerant flow mechanism having a refrigerant flow control element with a backside surface that produces less refrigerant turbulence as the flow of said refrigerant increases and more refrigerant turbulence as the flow of said refrigerant decreases.

10. Means for heating enhancement according to claim 7, wherein said high refrigerant flow, low pressure release check valve comprises a one-way refrigerant flow mechanism having a permanent magnet and magnet attracted valve plate that requires between about 0.5 psi and 2.0 psi to pass refrigerant.

11. Means for heating enhancement according to claim 7, wherein said high refrigerant flow, low pressure release check valve comprises a one-way refrigerant flow mechanism having a permanent magnet and magnet attracted valve plate, wherein said valve plate has a backside surface that produces less refrigerant turbulence as the flow of said refrigerant increases and more refrigerant turbulence as the flow of said refrigerant decreases.

12. In association with a refrigerant recirculating heat pump system, wherein said heat pump system has a compressor, a first heat exchanger, a second heat exchanger, and a first refrigerant flow line connecting said first and said second heat exchangers, wherein said system heats an environment associated with said first heat exchanger by transferring said refrigerant in a high pressure liquid form in a first direction through said first refrigerant flow line from said first heat exchanger to said second heat exchanger and cools said first heat exchanger associated environment by transferring said refrigerant in said high pressure liquid form in a second direction from said second heat exchanger to said first heat exchanger, enhancement means for increasing the efficiency of said heat pump, comprising:

a) a refrigerant block in said first refrigerant flow line between said first heat exchanger and said second heat exchanger, wherein said block prevents the direct flow of high pressure liquid refrigerant between said first heat exchanger to said second heat exchanger;

b) a bypass refrigerant line extending between said first and said second heat exchangers for carrying said high pressure liquid refrigerant around said refrigerant block;

c) means associated with said bypass refrigerant line for enhancing said heat pump system's cooling efficiency; and d) means associated with said bypass refrigerant line for enhancing said heat pump system's heating efficiency, wherein said heating enhancement means comprises at least one high refrigerant flow, low pressure release check valve inserted into said bypass line for incrementally heating said liquid refrigerant by producing turbulence in said liquid refrigerant before entering said second heat exchanger from said first heat exchanger in said first direction of refrigerant flow.

13. Means for enhancing the efficiency of a heat pump system according to claim 12, wherein said cooling enhancement means comprises at least one high refrigerant flow, low pressure release check valve inserted into said bypass line for incrementally lowering said liquid refrigerant's high pressure before entering said first heat exchanger from said second heat exchanger in said second direction of said refrigerant flow.

14. Means for enhancing the efficiency of a heat pump system according to claim 12, wherein said cooling enhancement means comprises a liquid refrigerant receiver inserted within said bypass flow line for incrementally lowering the pressure of said high pressure liquid refrigerant.

* * * * *